US005782319A

United States Patent [19]

Woodruff et al.

[11] Patent Number: 5,782,319

[45] Date of Patent: Jul. 21, 1998

[54] ELEVATOR CAR AND COUNTERWEIGHT SAFETY

[75] Inventors: Mark Jon Woodruff, Dallas, Tex.; Daniel Lee Vermeere, Moline; James William Bos, Fulton, both of Ill.

[73] Assignee: Montgomery Kone Inc., Moline, Ill.

[21] Appl. No.: 600,349

[22] Filed: Feb. 12, 1996

[51] Int. Cl.[6] ..... B66B 5/01

[52] U.S. Cl. ..... 187/376; 188/189

[58] Field of Search ..... 187/373, 376; 188/188, 189

[56] References Cited

U.S. PATENT DOCUMENTS

| | | | |
|---|---|---|---|
| 2,150,373 | 3/1939 | Hymans | 187/376 |
| 2,274,000 | 2/1942 | Sahlin | 187/90 |
| 3,346,074 | 10/1967 | Borden et al. | 187/376 |
| 3,441,107 | 4/1969 | Thorne et al. | 187/90 |
| 4,538,706 | 9/1985 | Koppensteiner | 187/90 |
| 4,819,765 | 4/1989 | Winkler et al. | 187/376 |
| 5,301,773 | 4/1994 | Jamieson et al. | 187/88 |
| 5,363,942 | 11/1994 | Osada | 187/376 |

*Primary Examiner*—Kenneth Noland

*Attorney, Agent, or Firm*—Wood, Phillips, VanSanten, Clark & Mortimer

[57] ABSTRACT

A braking device is described for an elevator having a governor that actuates above a tripping speed for braking an elevator car or counterweight that is guided on a vertical guide rail. The braking device includes a unitary safety housing attached to the elevator car or counterweight and at least partially surrounding the guide rail. The safety housing is expandable and has opposite, facing wedge guides on opposite sides of the guide rail. A pair of wedges are included, each being received between the guide rail and one of the wedge guides. An actuator is linked with a governor and the wedges for driving the wedges into the safety housing, forcing the safety housing to expand and produce a clamping force on the guide rail, in response to actuation of the governor.

16 Claims, 6 Drawing Sheets

ELEVATOR CAR AND COUNTERWEIGHT SAFETY

FIELD OF THE INVENTION

This invention relates to a braking device for an elevator and, more particularly, to a braking device including a unitary spring and housing

BACKGROUND OF THE INVENTION

Elevators are provided with various forms of braking devices for braking an elevator car or counterweight moving in an elevator hoistway. Among these is a device referred to as a "safety", used in emergency situations when other braking devices may have failed or are not operable. The safety is used for stopping and sustaining the entire elevator car or counterweight with its rated load from a tripping speed determined using a governor.

A conventional safety for an elevator car or counterweight that is guided on a vertical guide rail uses wedge devices for braking. Particularly, a resilient spring holds wedge guides on opposite sides of the rail. A wedge is disposed between each wedge guide and one side of the rail. An actuating mechanism is operable to force the wedges into the wedge guides when a tripping speed is exceeded. The engagement between the wedges and the wedge guides forces the wedges into the rail to produce a clamping force to stop the elevator car or counterweight. Such a structure requires additional components to provide the spring forces. Also, the safety typically includes rollers disposed between the wedges and the wedge guides.

The present invention is directed to improvements in braking devices for elevators.

SUMMARY OF THE INVENTION

In accordance with the invention there is provided a braking device for an elevator including a unitary safety housing.

Broadly, there is disclosed herein a braking device for an elevator having a governor that actuates above a tripping speed for braking an elevator car or counterweight that is guided on a vertical guide rail. The braking device includes a unitary safety housing attached to the elevator car or counterweight and at least partially surrounding the guide rail. The safety housing is expandable and has opposite, facing wedge guides on opposite sides of the guide rail. A pair of wedges are included, each being received between the guide rail and one of the wedge guides. An actuator is linked with a governor and the wedges for driving the wedges into the safety housing, forcing the safety housing to expand and produce a clamping force on the guide rail, in response to actuation of the governor.

In accordance with one aspect of the invention, the safety housing comprises a C-shaped housing receiving the guide rail, the safety housing including a plurality of outer ribs enabling the safety housing to operate with a controlled spring rate. The safety housing expands a maximum of about one-quarter inch. The safety housing is formed as an investment casting. The wedge guides comprise U-shaped pockets in the safety housing.

In accordance with another aspect of the invention the braking device includes a pair of inserts, each being sandwiched between one of the wedge guides and the wedge received therein, the insert having a low coefficient of friction. The plastic inserts have radiused back surfaces received in the pockets, allowing the wedges to pivot to maintain even pressure along the faces of the wedges as they engage the guide rail. The inserts comprise plastic inserts.

In accordance with a further aspect of the invention, the safety housing is loosely, pivotally attached to the car or counterweight, enabling the safety housing to selfcenter during actuation.

In accordance with another embodiment of the invention, the braking device includes a safety housing attached to the elevator car or counterweight and at least partially surrounding the guide rail. The safety housing includes opposite, facing wedge guides on opposite sides of the guide rail. A pair of wedges are included, each being received between the guide rail and one of the wedge guides. A pair of plastic inserts are included, each being sandwiched between one of the wedge guides and the wedge received therein. The inserts have a low coefficient of friction. An actuator is linked to the governor and the wedges for driving the wedges into the safety housing to produce a clamping force on the guide rail in response to actuation of the governor.

Further features and advantages of the invention will be readily apparent from the specification and from the drawing.

DETAILED DESCRIPTION OF THE INVENTION

Figure 1:
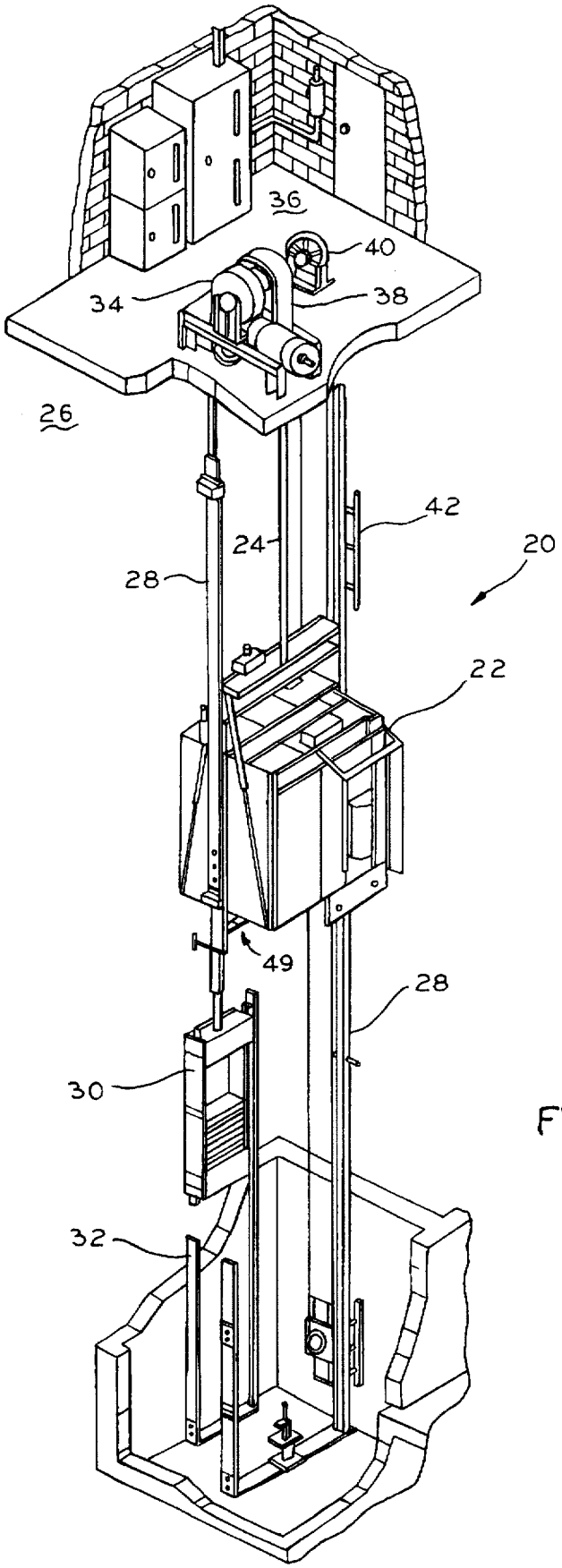
FIG. 1 is a partial, perspective view of an elevator in a hoistway including a braking device according to the invention.

Referring initially to FIG. 1, an elevator system 20 includes an elevator car 22 suspended by a cable 24 in a hoistway 26. The elevator car 22 is guided between vertical guide rails 28. A counterweight 30 is guided between guide rails 32 and is suspended on an opposite end of the cable 24.

Movement of the car 22 and counterweight 30 in the hoistway 26 is provided by a motor 34 mounted in a machine room 36. The motor 34 rotates a sheave 38 around which the cable 24 extends to raise and lower the car 22. A mechanical speed governor 40 is attached by a further cable 42 to the car 22. Particularly, the cable 42 is connected to a braking device 44 attached to the car 22 to prevent the car 22 from reaching an over-speed condition.

Figure 2:
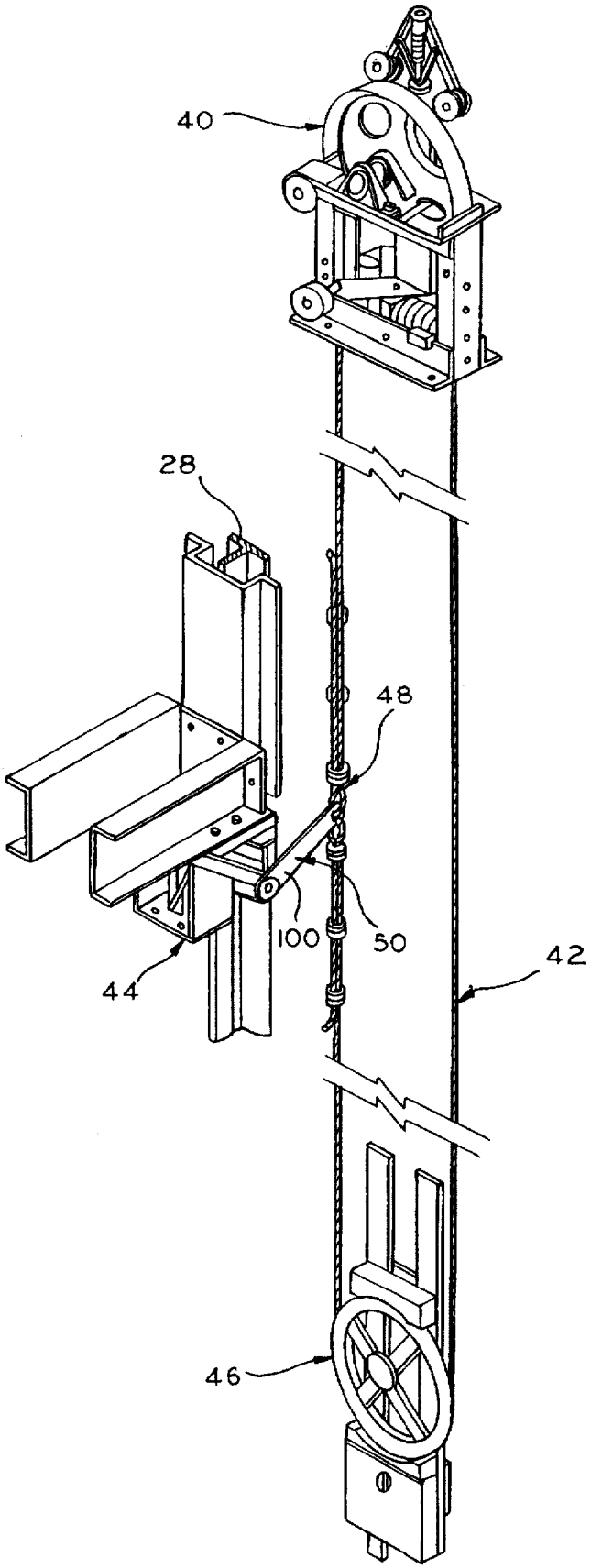
FIG. 2 is a partial, perspective view particularly illustrating the braking device of the elevator of FIG. 1 connected to a governor.
Figure 3:
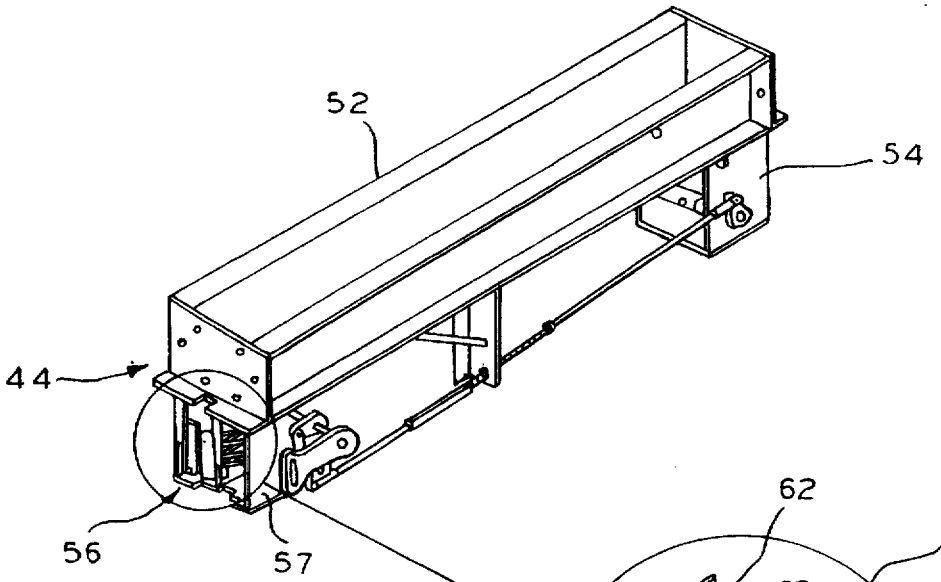
FIG. 3 is a perspective view of the braking device according to the invention.
Figure 4:
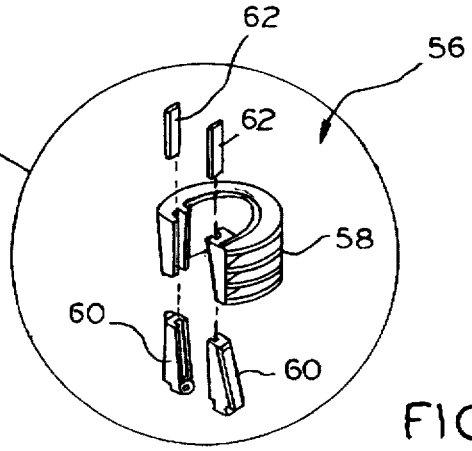
FIG. 4 is a detailed, exploded view of a safety spring block assembly of the braking device of FIG. 3.
Figure 5:
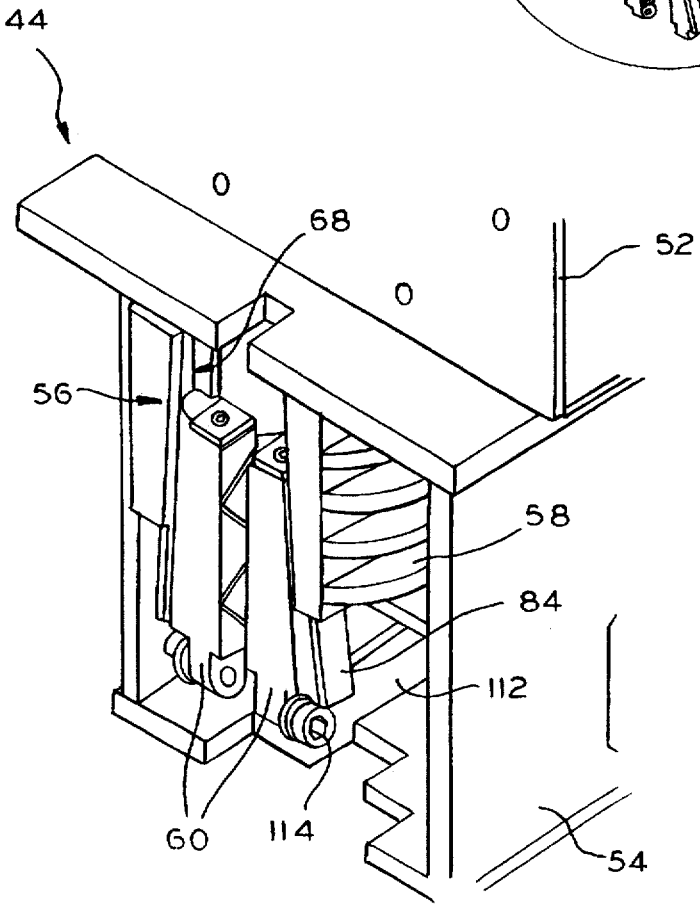
FIG. 5 is an enlarged detail of a portion of the braking device of FIG. 3.

Referring now to FIG. 2, the governor 40 and cable 42 are illustrated in greater detail. The cable 42 extends in a continuous loop about the governor 40 and a lower pulley 46. The cable 42 is connected as at 48 to an actuator 50 linked to the braking device 44. The governor 40 is operable to sense if the car 22 is falling at an excessive speed, as indicated by the speed of movement of the cable 42, and is operable to stop further movement of the cable 42 which restrains vertical movement of the actuator 50. However, because the car 22 continues to drop, the actuator 50 is pivoted, as described below, to actuate the braking device 44 to stop the car 22.

Referring to FIGS. 3–9, the braking device 44 is illustrated in greater detail. The braking device 44 includes a safety channel 52 attached by conventional means, not shown, to the underside of the elevator car 22. The safety channel 52 supports two safety spring block assemblies 56, each in an enclosure 54 secured to the underside at opposite ends of the safety channel 52. Each safety spring block assembly 56 is enclosed within one of the enclosure 54. As illustrated in greater detail in FIG. 4, the safety spring block assembly 56 includes a safety housing 58, a pair of wedges 60, and a pair of plastic inserts 62.

Figure 10:
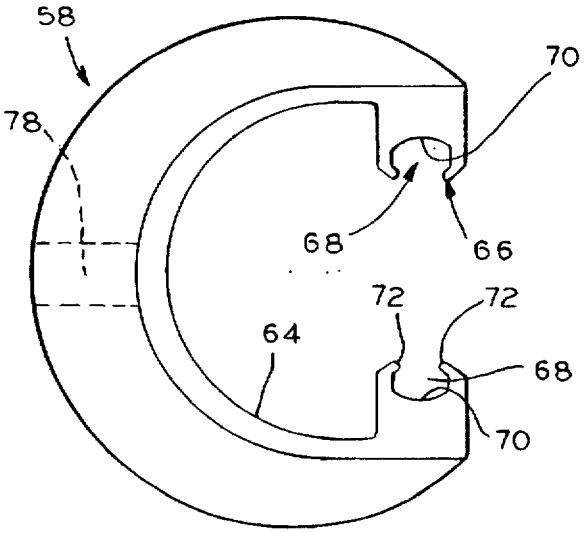
FIG. 10 is a top plan view of a safety housing of the braking device of FIG. 3.
Figure 11:
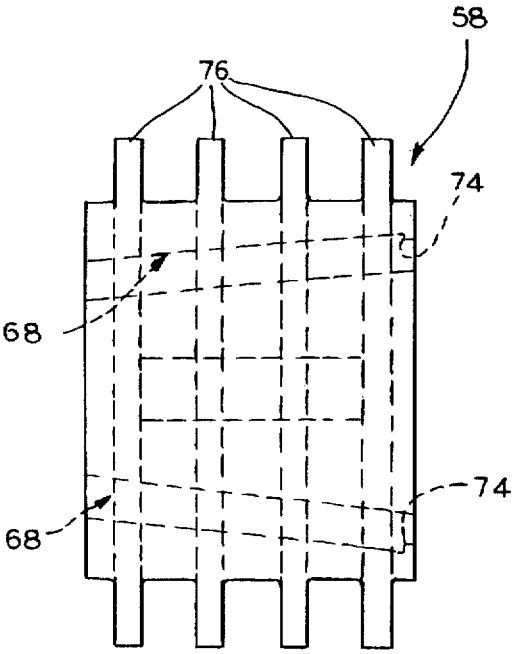
FIG. 11 is a side view of the safety housing of FIG. 10.

Referring now to FIGS. 10 and 11, the safety housing 58 is formed as an investment casting and comprises a C-shaped housing including a semi-circular inner radius 64. The radius 64 is partially closed by opposite, facing wedge guides 66. Each wedge guide 66 comprises a generally U-shaped pocket 68 having a radiused inner surface 70. The pockets 68 are inclined, as is particularly illustrated in FIG. 11, so that the wedge guide 66 itself acts as a wedge. The opening to the pocket 68 is narrowed by projections 72. A stop 74 is provided at a lower end of each pocket 68, as shown in FIG. 11.

The exterior of the housing 58 includes four axially spaced horizontal ribs 76 and a central vertical rib 78. The housing 58 is expandable as by the wedge guides 66 being movable away from one another. The horizontal and vertical ribs, 76 and 78, respectively, allow the housing 58 to behave with a controlled spring rate. This eliminates the need for additional, separate spring devices. The safety housing 58 is a unitary device with the wedge pockets 68 integrally cast into the housing 58.

Figure 14:
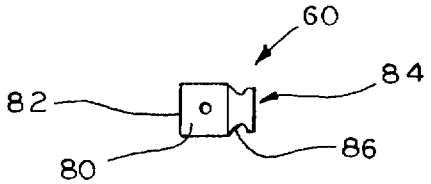
FIG. 14 is a top plan view of the wedge of FIG. 12.
Figure 12:
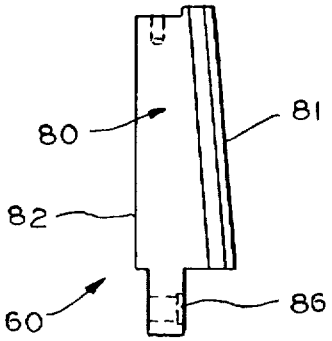
FIG. 12 is a side elevation view of a wedge of the braking device of FIG. 3.
Figure 13:
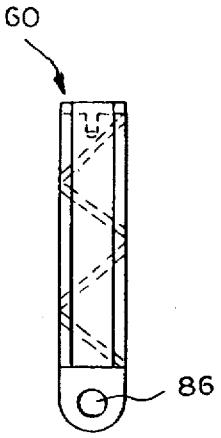
FIG. 13 is a front elevation view of the wedge of FIG. 12.

Referring to FIGS. 12–14, the wedge 60 is illustrated in greater detail. As discussed above, the spring block assembly 56 uses two wedges 60. Each is identical in construction and can be rotated 18020 according to the side of the safety housing 58 in which it is installed.

The wedge 60 comprises a one-piece cast block 80. The block 80 includes a generally flat outer surface 82 for engaging the guide rail 28 and an opposite wedge surface 84 which is inclined opposite the incline of the safety housing pockets 68, discussed above. An opening 86 extends through a bottom of the block 80 for connection to the actuator 50. The wedge surface 84 is coated with a material having a low coefficient of friction, such as Xylan 1010. The block 80 has a narrowed neck as at 86 extending parallel to the wedge surface 84. The neck 86 is of a dimension so that the wedge 60 is held in the wedge pocket 68 by the protrusions 72 extending into the neck 86. This relationship enables each wedge 60 to slide vertically in its associated wedge guide 66 with the wedge surface 84 facing the radiused surface 70 of the pocket 68, see FIG. 5.

Figure 15:
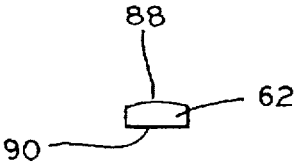
FIG. 15 is an end view of a plastic insert used in the braking device of FIG. 3.

Referring to FIG. 15, the insert 62 is illustrated. The insert 62 comprises a plastic insert having a low coefficient of friction. The insert 62 is of a length corresponding to the length of the wedge pocket 68 to be received therein. The inset 62 has a rear surface 88 which is radiused to correspond to the pocket radiused surface 70 and an opposite flat surface 90. The insert 62 is positioned within the wedge pocket 68 behind the wedge 60. Particularly, the flat surface 90 engages the wedge surface 84, while the radiused surface 88 engages the pocket radiused surface 70, as is generally illustrated in the drawings. The pocket stop 74 maintains the insert 62 in a desired vertical position.

Referring again to FIGS. 3–9, the enclosure 54 includes a central, horizontal support plate 92. A locator plate 94 is secured to the support plate 90 using fasteners 96. The locator plate 94 has a semi-circular outer radius 98 corresponding to the safety housing inner radius 64, as is particularly illustrated in FIG. 6. The safety housing 58 is loosely supported on the support plate 92 and is maintained in a desired position by the locator plate 94. As a result, the safety housing 58 pivots about the locator plate 94, as necessary, to self-center during actuation.

The actuator 50 includes a governor arm 100 for connection to the governor cable 42 as at 48, see FIG. 2. The governor arm 100 is connected to a governor arm shaft 102. As illustrated in phantom in FIG. 6, the governor arm 100 can be positioned on either side of the safety channel 52. The governor arm shaft 102 is connected via an upper pivot 104, a connecting link bar 106, and a lower pivot 108 to a pickup shaft 110. The pickup shaft 110 extends into the enclosure 54 where it is connected to a U-shaped lever 112 within the enclosure 54 below the support plate 90. Shoulder bolts 114 connect opposite legs of the lever 112 to the two wedges 60.

In operation, if the governor arm 102 is pivoted about the governor arm shaft, then this rotation is transmitted to the pickup shaft which rotates the lever 112 to drive the wedges 60 upwardly into the safety housing 58 to move the wedges 60 closer together.

Although not described, the enclosure 54 at the opposite end of the safety channel 52 similarly includes a safety spring block assembly 56. A threaded link rod 116 is connected via pivot 118 and a pickup shaft 120 to the lever 112 at the opposite end, as is apparent in FIG. 7.

Figure 6:
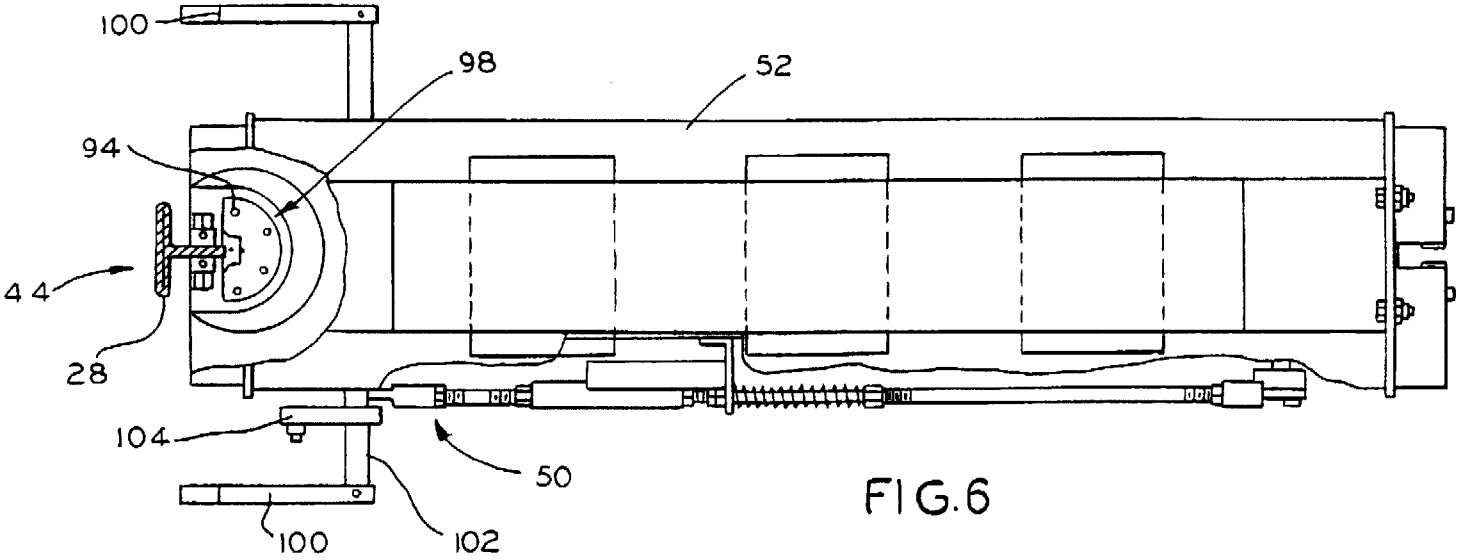
FIG. 6 is a top plan view of the braking device of FIG. 3.
Figure 7:
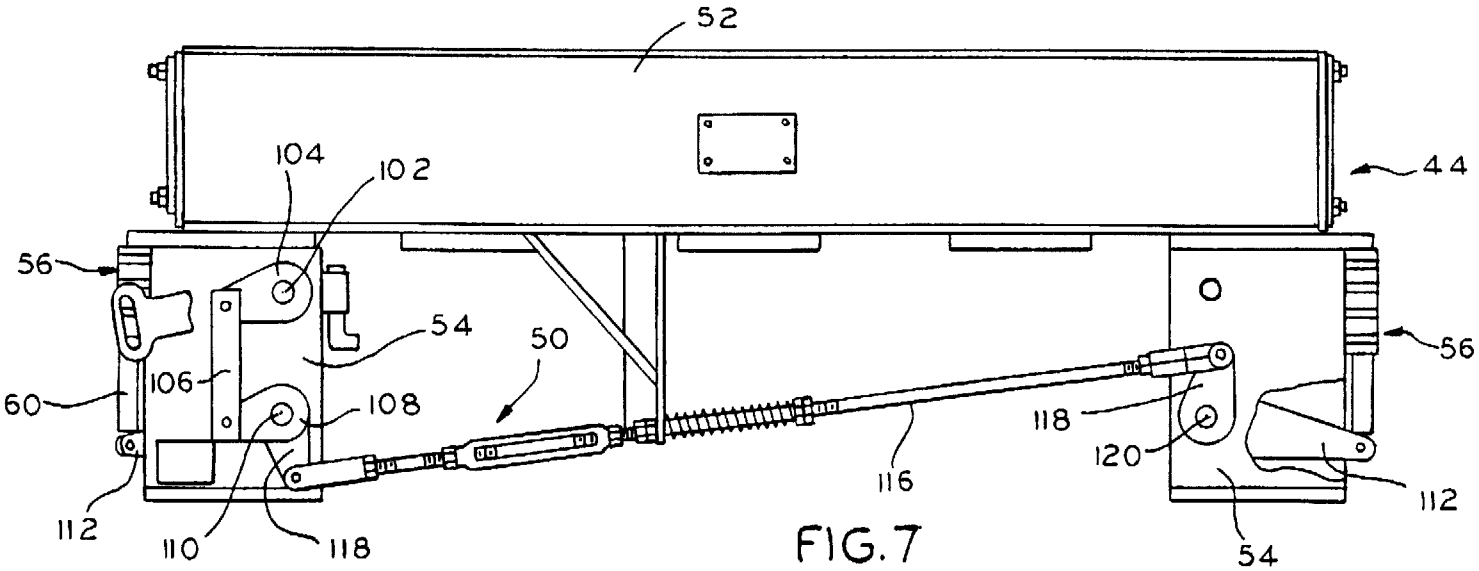
FIG. 7 is a side elevation view of the braking device of FIG. 3.
Figure 8:
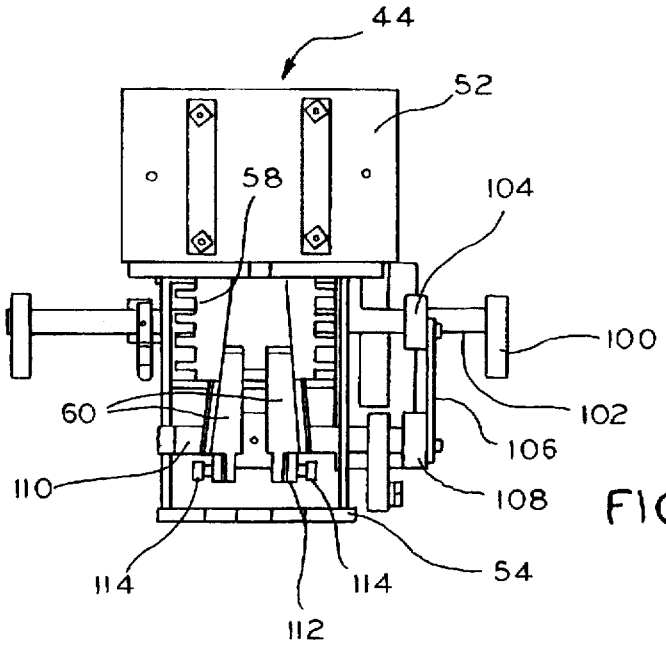
FIG. 8 is an end elevation view of the braking device of FIG. 3.
Figure 9:
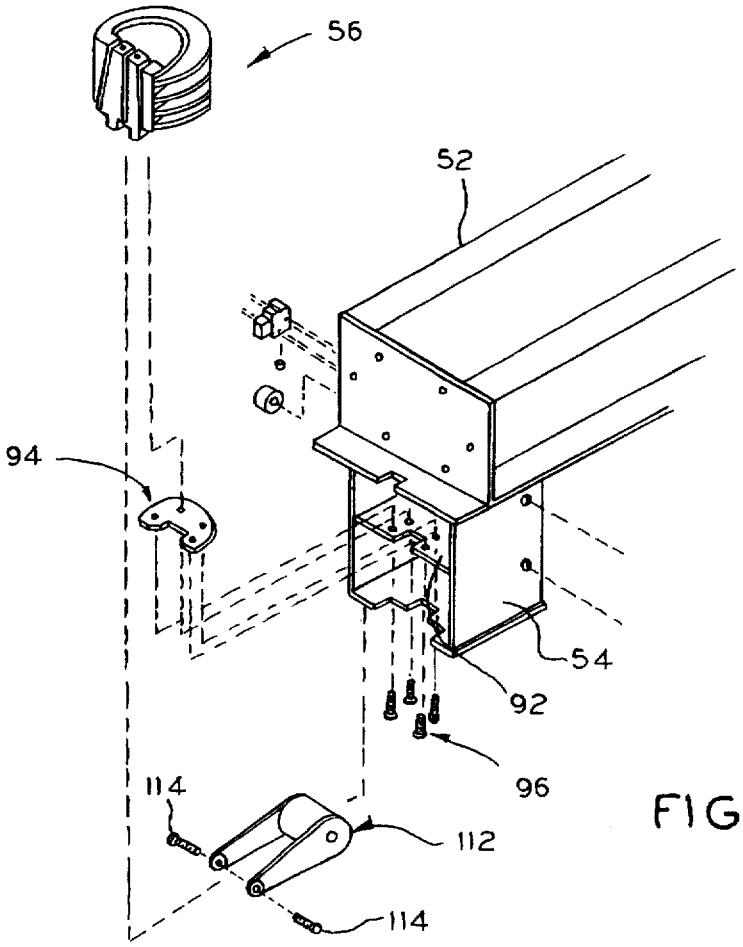
FIG. 9 is a partial, exploded perspective view of the braking device of FIG. 3.

FIG. 6 illustrates the vertical guide rail 28 in cross-section relative to the braking device 44. As shown, the wedges 60 are on opposite sides of the guide rail 28. As is apparent from the above discussion, upon actuation of the governor 40, the actuator 50 drives the wedges 60 into the safety housing 58. The engaging wedge surfaces 84 of the wedges 60 and the wedge pockets 68 force the safety housing 58 to expand. The expansion is limited to ¼ inch. This expansion produces a clamping force which is applied to the flat face of the guide rail 28. The clamping force remains until the car 22 slides to rest and the system is released. The braking device 44 releases once the car 22 is run upward, which will disengage the wedges 60 from the rail 28 and allow the safety housing 58 to relax to its initial setting.

As described above, the safety housing 58 operates as a spring mechanism and also houses the wedges 60 in a unitary device. This eliminates the need for additional spring devices and separate components for forming the wedge pockets. The new wedge design also eliminates the requirement for roller bearings. By using the radiused back surface of the plastic insert, the wedges 60 are allowed to pivot. The pivoting allows the wedges to maintain an even pressure along the outer face 82 as it engages the rail 28. The low coefficient of friction plastic of the insert 62 allows for proper sliding engagement without the need for rollers. Also, the physical properties of the plastic insert 62 allow it to accommodate both positive and negative wedge and safety housing pocket imperfections.

While the braking device 44 is described herein particularly in connection with the elevator car 22, the braking device 44 could also be used on the counterweight 30 as by securing it directly to the counterweight 30. As is apparent, the relative size of the components, such as the safety channel, would change according to the physical requirements, as would the components of the safety spring block assembly.

I claim:

1. A braking device for an elevator having a governor that actuates above a tripping speed for braking an elevator car or counterweight that is guided on a vertical guide rail, the braking device comprising:

a unitary safety housing attached to the elevator car or counterweight and at least partially surrounding the guide rail, the safety housing being expandable and having opposite, facing wedge guides on opposite sides of the guide rail;

a pair of wedges, each wedge being received between the guide rail and one of the wedge guides; and an actuator linked to the governor and the wedges for driving the wedges into the safety housing, forcing the safety housing to expand and produce a clamping force on the guide rail, in response to actuation of the governor.

2. The braking device of claim 1 wherein said safety housing comprises a C-shaped housing receiving the guide rail, the safety housing including a plurality of outer ribs enabling the safety housing to operate with a controlled spring rate.

3. The braking device of claim 2 wherein the safety housing expands a maximum of about ¼ inch .

4. The braking device of claim 1 wherein said safety housing is formed as an investment casting.

5. The braking device of claim 1 wherein said wedge guides comprise U-shaped pockets in the safety housing.

6. The braking device of claim 1 further comprising a pair of inserts, each being sandwiched between one of the wedge guides and the wedge received therein, wherein the inserts have a low coefficient of friction.

7. The braking device of claim 6 wherein said wedge guides comprise U-shaped pockets and the plastic inserts have radiused back surfaces received in the pockets allowing the wedges to pivot to maintain even pressure along the faces of the wedges as they engage the guide rail.

8. The braking device of claim 6 wherein the inserts comprise plastic inserts.

9. The braking device of claim 1 wherein the safety housing is loosely, pivotally attached to the car or counterweight enabling the safety housing to self center during actuation.

10. A braking device for an elevator having a governor that actuates above a tripping speed for braking an elevator car or counterweight that is guided on a vertical guide rail, the braking device comprising:

a safety housing attached to the elevator car or counterweight and at least partially surrounding the guide rail, the safety housing including opposite, facing wedge guides on opposite sides of the guide rail;

a pair of wedges, each wedge being received between the guide rail and one of the wedge guides;

a pair of plastic inserts, each being sandwiched between one of the wedge guides and the wedge received therein, the inserts having a low coefficient of friction; and an actuator linked to the governor and the wedges for driving the wedges into the safety housing to produce a clamping force on the guide rail, in response to actuation of the governor.

11. The braking device of claim 10 wherein said safety housing comprises a C-shaped housing receiving the guide rail, the safety housing including a plurality of outer ribs enabling the safety housing to operate with a controlled spring rate.

12. The braking device of claim 11 wherein the safety housing expands a maximum of about ¼ inch.

13. The braking device of claim 10 wherein said safety housing is formed as an investment casting.

14. The braking device of claim 10 wherein said wedge guides comprise U-shaped pockets in the safety housing.

15. The braking device of claim 10 wherein said wedge guides comprise U-shaped pockets and the plastic inserts have radiused back surfaces received in the pockets allowing the wedges to pivot to maintain even pressure along the faces of the wedges as they engage the guide rail.

16. The braking device of claim 10 wherein the safety housing is loosely, pivotally attached to the car or counterweight enabling the safety housing to self center during actuation.

* * * * *